US007417607B2

(12) United States Patent
Miyazawa

(10) Patent No.: US 7,417,607 B2
(45) **Date of Patent: *Aug. 26, 2008**

(54) ELECTRO-OPTICAL DEVICE AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 791 days.

This patent is subject to a terminal disclaimer.

(21) Appl. No.: 10/915,377

(22) Filed: Aug. 11, 2004

(65) Prior Publication Data

US 2005/0052367 A1 Mar. 10, 2005

(30) Foreign Application Priority Data

Aug. 21, 2003 (JP) ..... 2003-297657

(51) Int. Cl.
*G09G 3/30* (2006.01)

(52) U.S. Cl. ..... 345/76; 345/81; 345/84; 345/92; 345/210

(58) Field of Classification Search ..... 345/76–100, 345/204–215
See application file for complete search history.

(56) References Cited

U.S. PATENT DOCUMENTS

| | | | | |
|---|---|---|---|---|
| 6,262,704 | B1 | 7/2001 | Kurumisawa et al. | |
| 6,496,174 | B2 | 12/2002 | Kurumisawa et al. | |
| 6,777,888 | B2 | 8/2004 | Kondo | |
| 6,885,029 | B2 * | 4/2005 | Miyazawa | 257/59 |
| 7,098,705 | B2 * | 8/2006 | Miyazawa | 327/112 |
| 7,158,105 | B2 * | 1/2007 | Miyazawa | 345/76 |
| 7,227,517 | B2 | 6/2007 | Imamura | |
| 2002/0047839 | A1 | 4/2002 | Kasai | |
| 2003/0016190 | A1 | 1/2003 | Kondo | |
| 2003/0103022 | A1 | 6/2003 | Noguchi et al. | |
| 2003/0137503 | A1 | 7/2003 | Kimura et al. | |
| 2004/0080882 | A1 | 4/2004 | Miyazawa | |
| 2004/0095338 | A1 | 5/2004 | Miyazawa | |
| 2004/0100427 | A1 | 5/2004 | Miyazawa | |
| 2006/0261864 | A1 * | 11/2006 | Miyazawa | 327/112 |

FOREIGN PATENT DOCUMENTS

| | | |
|---|---|---|
| CN | 1437178 A | 8/2003 |
| JP | A 2001-228835 | 8/2001 |
| JP | A-2003-186436 | 7/2003 |
| JP | A 2003-208127 | 7/2003 |
| JP | A-2003-263129 | 9/2003 |
| JP | A-2003-295824 | 10/2003 |
| JP | A-2004-7572 | 1/2004 |
| JP | A-2004-70074 | 3/2004 |
| JP | A-2004-145278 | 5/2004 |
| WO | WO 02/075709 A1 | 9/2002 |
| WO | WO 03/019517 A1 | 3/2003 |

* cited by examiner

*Primary Examiner*—Vijay Shankar
(74) *Attorney, Agent, or Firm*—Oliff & Berridge, PLC

(57) ABSTRACT

A capacitor is disposed between a gate of driving transistor of which conduction state correspond to a driving current supplied to a driven element. The gate voltage of the gate of the driving transistor is set by supplying a data current to the driving transistor or a compensating transistor for the driving transistor.

20 Claims, 10 Drawing Sheets

ELECTRO-OPTICAL DEVICE AND ELECTRONIC APPARATUS

BACKGROUND OF THE INVENTION

1. Field of Invention

The present invention relates to electronic devices, particularly electro-optical devices, and to electronic apparatuses. More particularly, the invention relates to a pixel circuit of a voltage-follower-type current program system.

2. Description of Related Art

Displays using organic EL (Electronic Luminescence) elements are attracting people's attention. An organic EL element is one of current-driven elements of which the luminance is determined by the driving current flowing through the elements. One of the methods for writing data into pixels using organic EL elements is a current program system in which data is supplied to data lines based on a current. FIG. 10 is a known pixel circuit diagram of a voltage-follower-type (sometimes referred to as a "source-follower-type") current program system. This pixel circuit is formed of an organic EL element OEL, a capacitor C, and four n-channel transistors. During the writing period in which data is written into the capacitor C by turning ON the switching transistors T1 and T2, the control transistor T4 is turned OFF to electrically separate the driving transistor T3 from a power supply voltage Vdd. The control transistor T4, which supplies the power supply voltage Vdd to one end (drain) of the driving transistor T3, is provided for each pixel circuit, and controls each pixel line extending along a scanning line.

SUMMARY OF THE INVENTION

According to the present invention, the number of transistors forming a pixel circuit of a voltage-follower-type current program system can be reduced.

According to the present invention, variations and deterioration in the characteristics of a driving transistor such as the threshold voltage can be suppressed.

A first electro-optical device of the present invention includes a plurality of scanning lines; a plurality of data lines, a plurality of voltage supply lines, a switch circuit that controls the supply of a voltage to each of the plurality of voltage supply lines, and a plurality of pixel circuits that are disposed at intersections of the plurality of scanning lines and the plurality of data lines and which are coupled to one of the voltage supply lines. Each of the plurality of pixel circuits includes an electro-optical element whose luminance corresponding to a driving current that flows through the electro-optical element, an n-channel driving transistor that is disposed between one of the plurality of voltage supply lines and the electro-optical element and whose conduction state in a driving period being set according to data, and a capacitor that has one electrode coupled with the gate of the driving transistor and the other electrode coupled with a node that couples the driving transistor and the electro-optical element, the capacitor retaining electric charge based on a data current supplied via the data line in writing period before the driving period.

In the aforementioned electro-optical device, each of the plurality of pixel circuits may further include a first switching transistor that has one terminal coupled with one of the plurality of data lines and whose the conduction state of the first switching transistor is controlled by a scanning signal supplied via one of the plurality of scanning lines, and a second switching transistor that has one terminal coupled with one of the plurality of voltage supply lines and the other terminal coupled with the gate of the driving transistor.

In the aforementioned electro-optical device, the plurality of scanning lines may include a plurality of first sub-scanning lines and a plurality of second sub-scanning lines.

Each of the plurality of pixel circuits may include a first switching transistor that has one terminal coupled with one of the plurality of data lines and whose the conduction state is controlled by a first scanning signal supplied via one of the plurality of first sub-scanning lines and a second switching transistor that has one terminal coupled with one of the plurality of voltage supply lines and the other terminal coupled with the gate of the driving transistor and whose the conduction state is controlled by a second scanning signal supplied via one of the plurality of second sub-scanning lines.

In the aforementioned electro-optical device, each of the plurality of voltage supply lines may preferably be settable to a plurality of voltages.

In the aforementioned electro-optical device, a current flows through the driving transistor in an annealing period in a direction that is opposite to the direction in which the driving current flows.

With this arrangement, change or n in the characteristics such as a threshold voltage shift deterioration of the driving transistor can be suppressed.

In the aforementioned electro-optical device, the driving transistor in an annealing period may be set to a conduction state equivalent to or lower than the lowest conduction state of the conduction states of the driving transistor set by the data current in the writing period.

In the aforementioned electro-optical device, the plurality of voltage supply lines may preferably be extended in the direction intersecting with the plurality of data lines.

A second electro-optical device of the present invention includes a plurality of scanning lines, a plurality of data lines, a plurality of voltage supply lines extending in the direction intersecting with the plurality of data lines, and a plurality of pixel circuits which are disposed at intersections of the plurality of scanning lines and the plurality of data lines and which are coupled to one of the voltage supply lines. Each of the plurality of pixel circuits includes a driving transistor, an electro-optical element whose luminance is set in accordance with the conduction state of the driving transistor, and a capacitor having one electrode coupled with the gate of the driving transistor and the other electrode coupled with a node that couples the driving transistor and the electro-optical element, the capacitor retaining electric charge based on a data current supplied and in a writing period before the driving period via one of the plurality of data lines.

In the aforementioned electro-optical device, among the plurality of pixel circuits, a group of the plurality of pixel circuits arranged in a direction in which one of the plurality of scanning lines is extended may be preferably coupled with one of the plurality of voltage supply lines.

In the aforementioned electro-optical device, each of the plurality of pixel circuits may include the driving transistor, a first switching transistor controlled by a scanning signal supplied via one of the plurality of scanning lines, and a second switching transistor controlling electrical coupling between the gate and the drain of the driving transistor. Transistors included in each of the plurality of pixel circuits may preferably be only three transistors, i.e., the driving transistor, the first switching transistor, and the second switching transistor.

A third electro-optical device of the present invention includes a plurality of scanning lines, a plurality of data lines, and a plurality of pixel circuits disposed at intersections of the plurality of scanning lines and the plurality of data lines. Each of the plurality of pixel circuits includes an electro-optical element, a driving transistor having a first terminal and a second terminal between which a channel region is provided, a capacitor having a first electrode coupled with a first gate of the driving transistor and a second electrode coupled with the first terminal, a first transistor that includes a second gate coupled with one of the plurality of scanning lines and that has a third terminal and a fourth terminal between which a channel region is provided, and a second transistor that has a third gate and that has a fifth terminal and a sixth terminal between which a channel region is provided. The fourth terminal is coupled with one of the plurality of data lines. The electro-optical element is coupled with the first terminal. Transistors included in each of the plurality of pixel circuits are only the driving transistor, the first transistor, and the second transistor.

In the aforementioned electro-optical device, the fifth terminal may be coupled with the first gate, and the sixth terminal may be coupled with the second terminal.

In the aforementioned electro-optical device, the third terminal may be coupled with the second electrode of the capacitor and with the first terminal.

In the aforementioned electro-optical device, the fifth terminal may be coupled with the first gate, and the sixth terminal may be directly connected to the third gate.

By directly connecting the sixth terminal to the third gate, the second transistor becomes a diode-connected transistor. The second transistor can be used as a transistor for compensating for the characteristics of the driving transistor.

The aforementioned electro-optical device may further include a plurality of first voltage supply lines, and a plurality of second voltage supply lines. The second terminal may preferably be coupled with one of the plurality of first voltage supply lines. The sixth terminal may preferably be coupled with one of the plurality of second voltage supply lines. Each of the plurality of second voltage supply lines may preferably be settable to a plurality of potentials.

The aforementioned electro-optical device may further include a plurality of first voltage supply lines, and a plurality of second voltage supply lines. The second terminal may be coupled with one of the plurality of first voltage supply lines. The sixth terminal may be coupled with one of the plurality of second voltage supply lines. Each of the plurality of second voltage supply lines may be settable to either one of a predetermined voltage and a floating state. The above-described predetermined voltage may include a plurality of voltages.

In the aforementioned electro-optical device, the plurality of voltage supply lines may preferably be extended in the direction intersecting with the plurality of data lines.

The electro-optical device may further include a plurality of first voltage supply lines, and a plurality of second voltage supply lines. The second terminal may be preferably coupled with one of the plurality of first voltage supply lines. The sixth terminal may preferably be coupled with one of the second voltage supply lines. One of the second voltage supply lines may preferably be set to a predetermined potential at least in part of a writing period in which the conduction state of the driving transistor is set according to a data current to pass through the second transistor.

In the aforementioned electro-optical device, all the transistors included in the pixel circuits may be n-channel transistors formed of amorphous silicon.

In an electronic apparatus of the present invention, any one of the above-described electro-optical devices is installed.

According to an aspect of the present invention, the number of transistors included in a pixel circuit can be reduced. Thus, the manufacturing yield and the aperture ratio of the electro-optical device can be improved, and the area occupied by the pixel circuit can be reduced.

According to another aspect of the present invention, a reverse bias can be applied, and thus, variations and deterioration in the characteristics of, in particular, amorphous silicon TFTs, can be compensated for.

DETAILED DESCRIPTION OF PREFERRED EMBODIMENTS (First Exemplified Embodiment)

Figure 1:
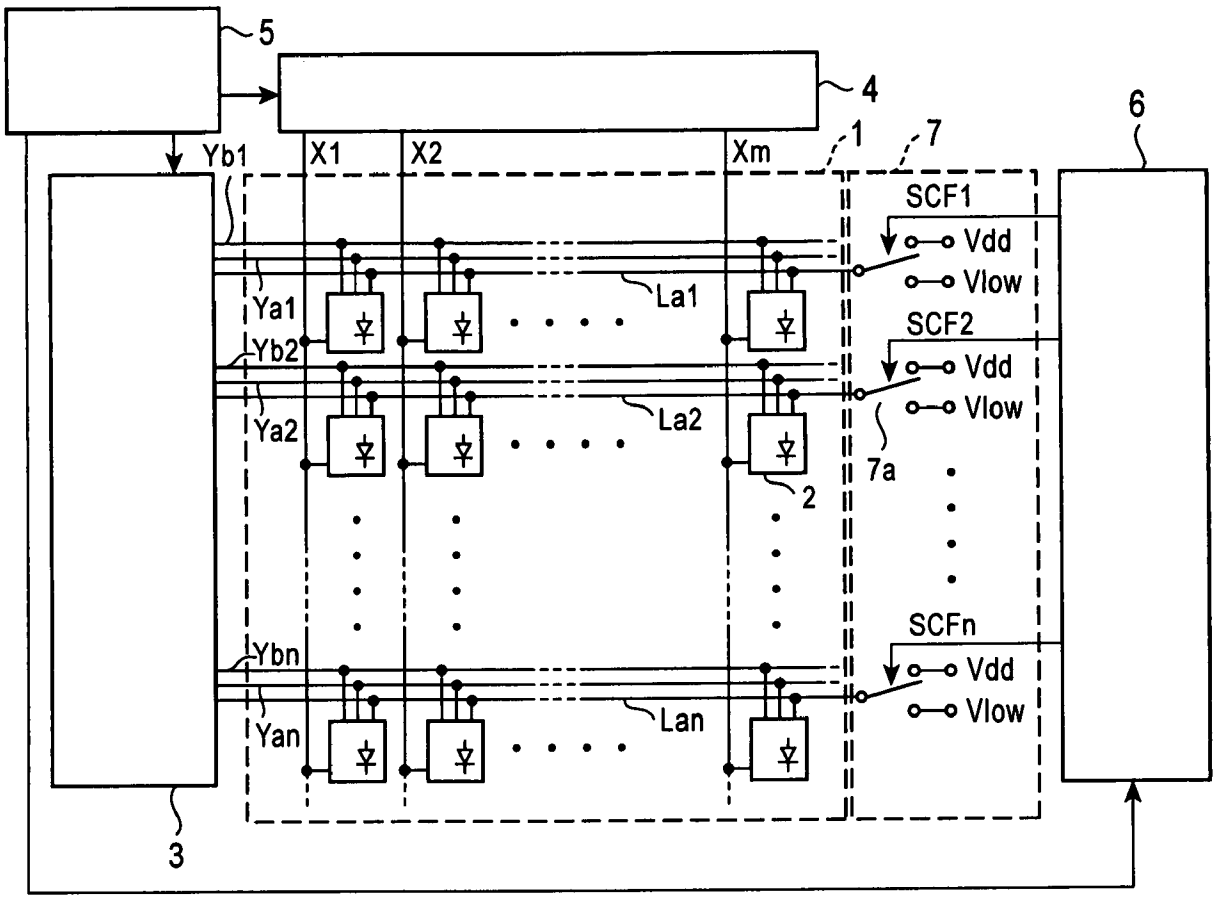
FIG. 1 is a block diagram illustrating an electro-optical device.

FIG. 1 is a block diagram illustrating an electro-optical device according to a first embodiment. A display portion 1 is an active matrix display panel, for example, in which electro-optical elements are driven by TFTs (Thin Film Transistors). Since in this embodiment the TFTs are formed of amorphous silicon, the channel type is basically an n type. In the display portion 1, m-dot×n-line pixels are disposed in a matrix (two-dimension). In the display portion 1, scanning lines Y1 through Yn extending in the horizontal direction and data lines X1 through Xm extending in the vertical direction are provided, and pixels 2 (pixel circuits) are disposed at the corresponding intersections of the scanning lines and the data lines. Each of the scanning lines Y1 through Yn is formed of two types of sub-scanning lines Ya and Yb. Voltage supply lines La1 through Lan are provided for the corresponding scanning lines Y1 through Yn in the direction intersecting with the data lines X1 through Xm, in other words, in the direction in which the scanning lines Y1 through Yn are extended. A pixel line (pixels 2 for m dots) corresponding to one scanning line Y is coupled in common to each of the voltage supply lines La1 through Lan. Although in this embodiment one pixel 2 is used as the minimum unit for displaying an image, one pixel 2 may be formed of three RGB sub pixels.

A control circuit 5 controls a scanning-line drive circuit 3, a data-line drive circuit 4, and a power-supply-line control circuit 6 in synchronization with each other based on a vertical synchronizing signal Vs, a horizontal synchronizing signal Hs, a dot clock signal DCLK, grayscale data D, etc. input from a host device (not shown). Under this synchronizing control, the circuits 3, 4, and 6 control the display operation of the display portion 1 in cooperation with each other.

The scanning-line drive circuit 3, which is mainly formed of a shift register and an output circuit, outputs a scanning signal to the scanning lines Y1 through Yn so as to scan them. The scanning signal takes a binary signal level, i.e., a high potential level (hereinafter referred to as the "H level") and a low potential level (hereinafter referred to as the "L level"). The first sub-scanning line Ya and the second sub-scanning line Yb corresponding to a pixel line into which data is written are set to be the H level so as to turn ON the n-type switching transistors T1 and T2 of the pixel circuit 2, which is described below.

The data-line drive circuit 4 is mainly formed of a shift register, a line latch circuit, and an output circuit. Since the current program system is employed in this electro-optical device, the data-line drive circuit 4 includes a variable current source for converting data (data voltage Vdata) corresponding to the display grayscale of the pixel 2 into a data current Idata. In one horizontal scanning period (1H) corresponding to the period for selecting one scanning line Y, the data-line drive circuit 4 simultaneously outputs the data current Idata corresponding to a pixel line into which data is written. At the same time, the data-line drive circuit 4 latches data to be written into a pixel line in the subsequent 1H. In 1H, m items of data corresponding to the number of data lines X are latched. Then, in the subsequent 1H, the latched m items of data are converted into the data currents Idata, and are output to the data lines X1 through Xm.

The power-supply-line control circuit 6 is mainly formed of a shift register and an output circuit, and in response to the scanning operation by the scanning-line drive circuit 3, the power-supply-line control circuit 6 controls a switch circuit 7 for switching the supply of a voltage to the voltage supply lines La1 through Lan. The switch circuit 7 is a circuit for setting each of the voltage supply lines La1 through Lan to one of a plurality of potentials Vdd and Vlow. The switch circuit 7 is formed of n switches 7*a* corresponding to the voltage supply lines La1 through Lan, and the n switches 7*a* are controlled by control signals SCF1 through SCFn output from the power-supply-line control circuit 6. The switch circuit 7 may be disposed on the same substrate as the substrate on which the display portion 1 is provided, or may be disposed on a substrate different from the substrate for the display portion 1.

Figure 2:
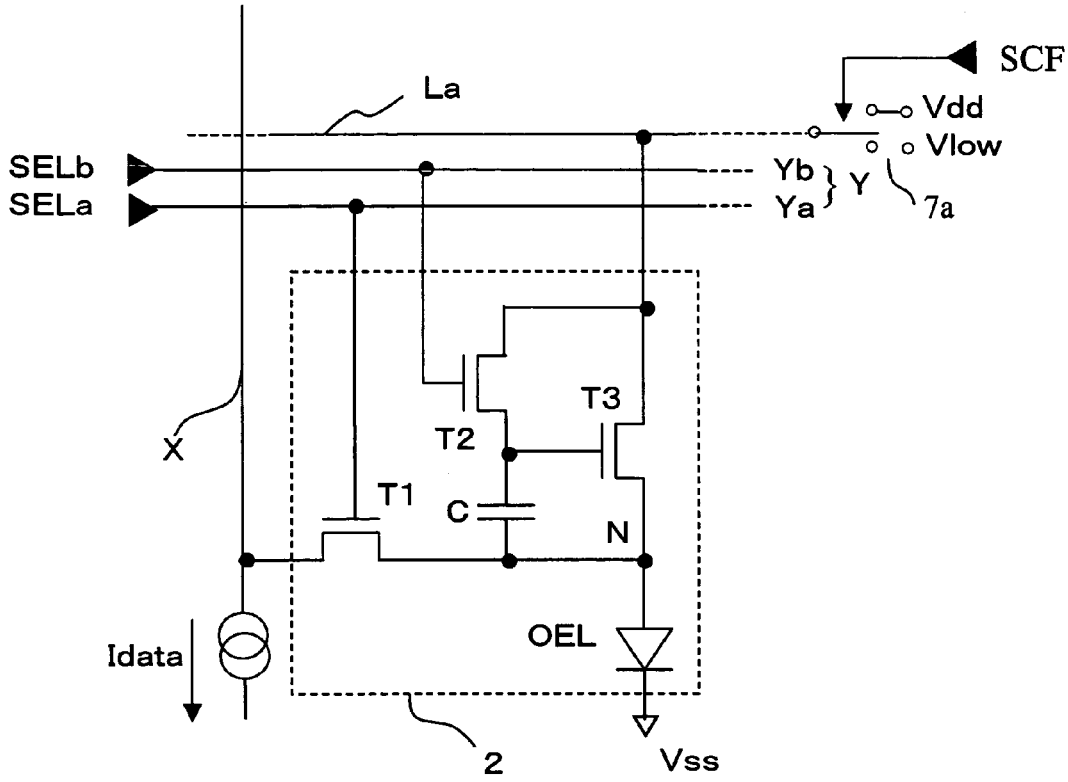
FIG. 2 is a pixel circuit diagram according to a first embodiment.

FIG. 2 is a pixel circuit diagram of a voltage-follower-type current program system according to this exemplified embodiment. One pixel circuit includes an organic EL element OEL, which is one mode of the current-driven element, three n-channel transistors T1 through T3, and a capacitor C for retaining data therein.

A gate of the first switching transistor T1 is coupled with one sub-scanning line Ya to which a first scanning signal SELa is supplied. One of two terminals (a source and a drain) of the first switching transistor T1 is coupled with one data line X to which the data current Idata is supplied while the other of the two terminal of the first switching transistor T1 is coupled with one of two terminals (a source and a drain) of the driving transistor T3.

The gate of the second switching transistor T2 is coupled with the sub-scanning line Yb. One of two terminals (a source and a drain) of the second switching transistor T2 is coupled with the voltage supply line La while the other of the two terminals of the second switching transistor T2 is coupled with the gate of the driving transistor T3.

One of two terminals (a source and a drain) of the driving transistor T3 is coupled with a pixel electrode of the organic EL element OEL and one electrode of the capacitor C while the other of the two terminals the driving transistor T3 is coupled with the voltage supply line La. A gate of the driving transistor T3 is coupled with the other electrode of the capacitor C.

The pixel electrode of the organic EL element OEL of this exemplified embodiment act as an anode. A reference voltage Vss lower than the power supply voltage Vdd is applied to the cathode (negative electrode) of the organic EL element OEL.

Figure 3:
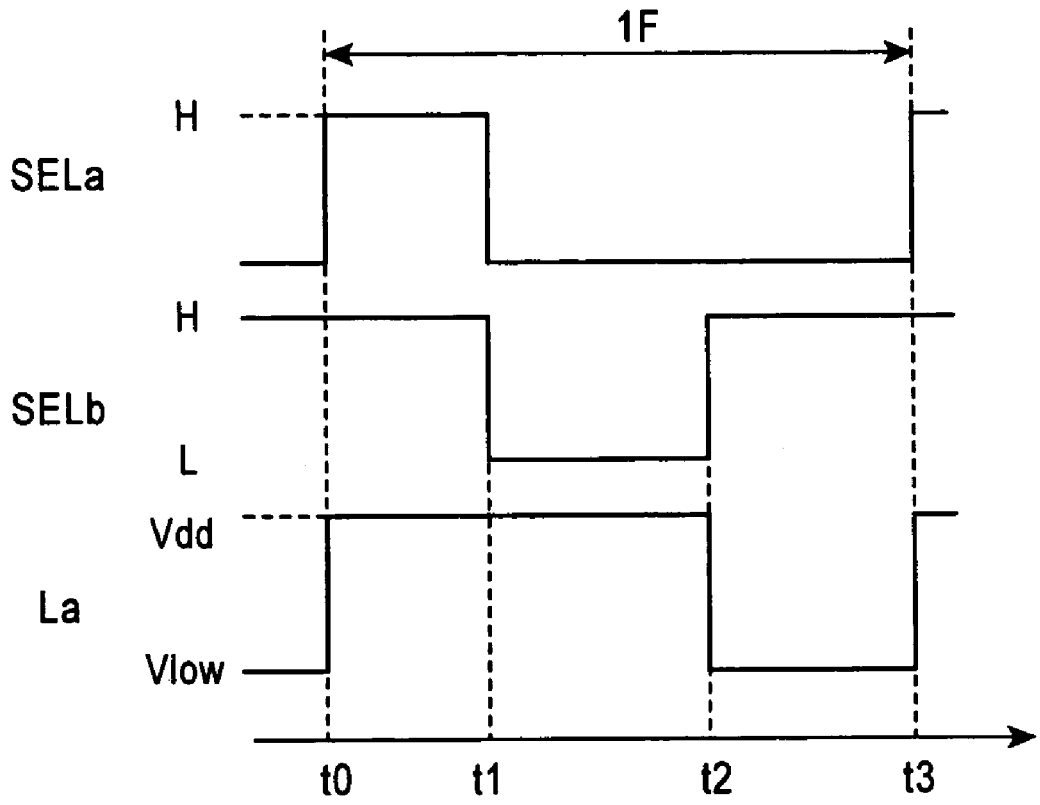
FIG. 3 is an operation timing chart of a pixel circuit.

FIG. 3 is a timing chart of the operation of the pixel circuit shown in FIG. 2. The operation process of the pixel circuit is largely divided into a data writing process in a writing period t0 to t1, which is the first part of 1F, and a driving process in a driving period t1 to t2, which is the second part of 1F. In this embodiment, however, an annealing period t2 to t3 is provided after the driving period t1 to t2 so as to suppress variations or deterioration in the characteristics of the driving transistor.

Figure 4:
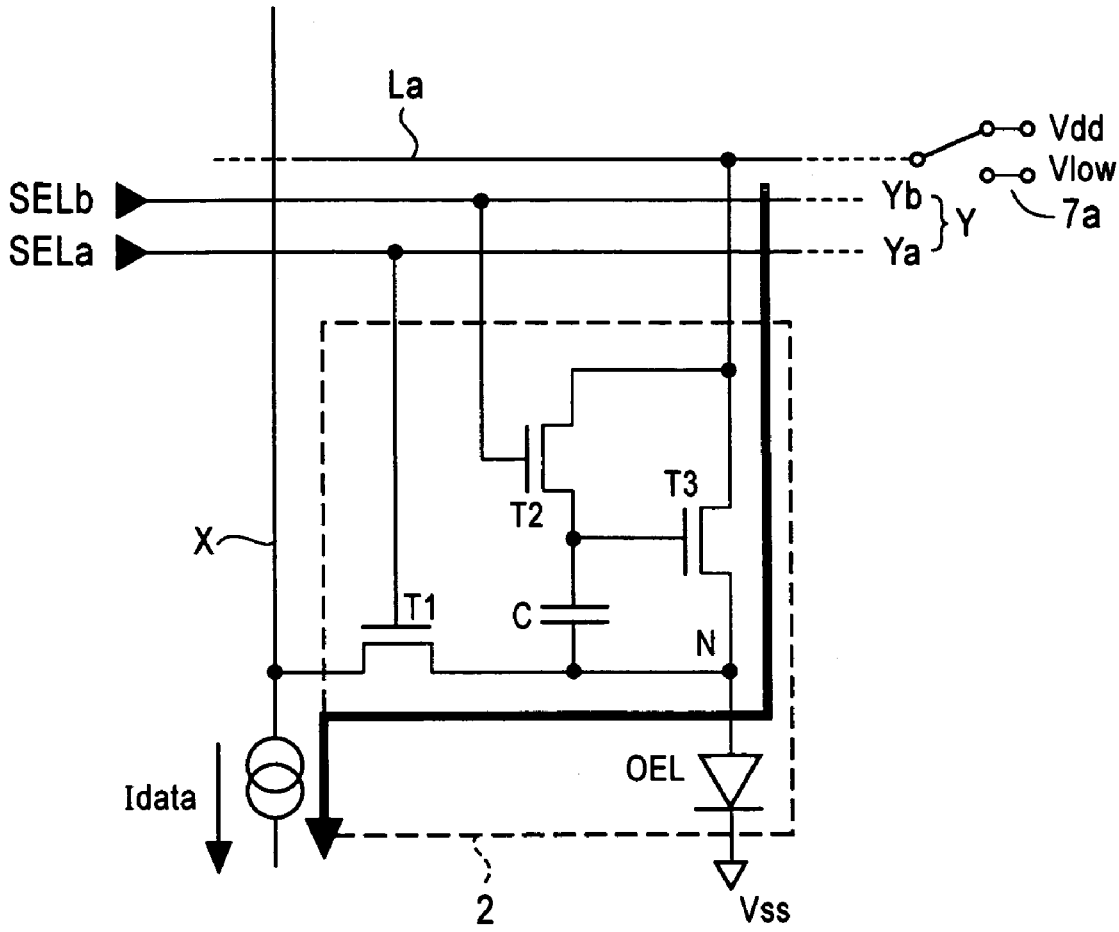
FIG. 4 illustrates a data current path in the writing period.

In the writing period t0 to t1 before the driving period t1 to t2, data is written into the capacitor C. More specifically, the scanning signals SELA and SEL2 are changed to the H level so as to turn ON the switching transistors T1 and T2. This electrically couples the data line X and the source of the transistor T3 via the first switching transistor T1 . Also, the driving transistor T3 becomes a diode-connected transistor in which the gate and the drain thereof are electrically coupled with each other via the transistor T2. In "synchronization" with a change in the scanning signals SELa and SELb to the H level, Vdd is selected from a plurality of voltages Vdd and Vlow by the control signal SCF so that the potential of the voltage supply line La is set to Vdd. In this specification, the term "synchronization" means "the same timing", and also includes an allowance of a temporal offset due to the designing margin. As a result, a current path is formed, as shown in FIG. 4, from the voltage supply line La to the data line X via the first switching transistor T1 and the driving transistor T3. In the driving transistor T3, a program current corresponding to the data current Idata flows through the channel of the driving transistor T3, and the voltage corresponding to the data current Idata is stored in the capacitor C as the difference Vgs between the source voltage and the gate voltage of the driving transistor T3.

To allow the current flowing between the source and the drain of the driving transistor T3 to selectively flow to the data line X, the resistance of the data line X is preferably set to be sufficiently lower than the resistance of the organic EL element OEL. By estimating the ratio of the current level of the current flowing to the data line X to that of the current flowing through the organic EL element OEL, the luminance can be correctly identified as the function of the data current Idata. In the writing period t0 to t1, since the organic EL element OEL and the driving transistor T3 are not electrically separated, the organic EL element OEL may start emitting light.

Figure 5:
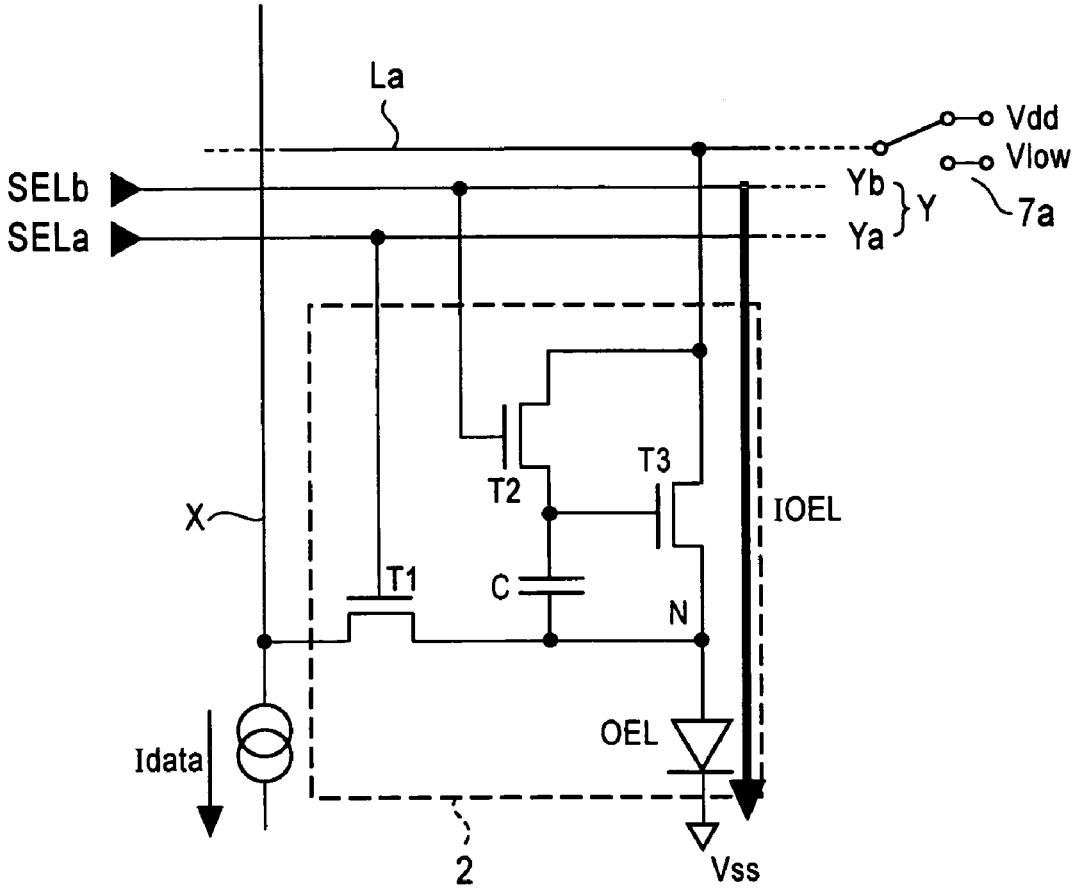
FIG. 5 illustrates a driving current path in the driving period.
Figure 6:
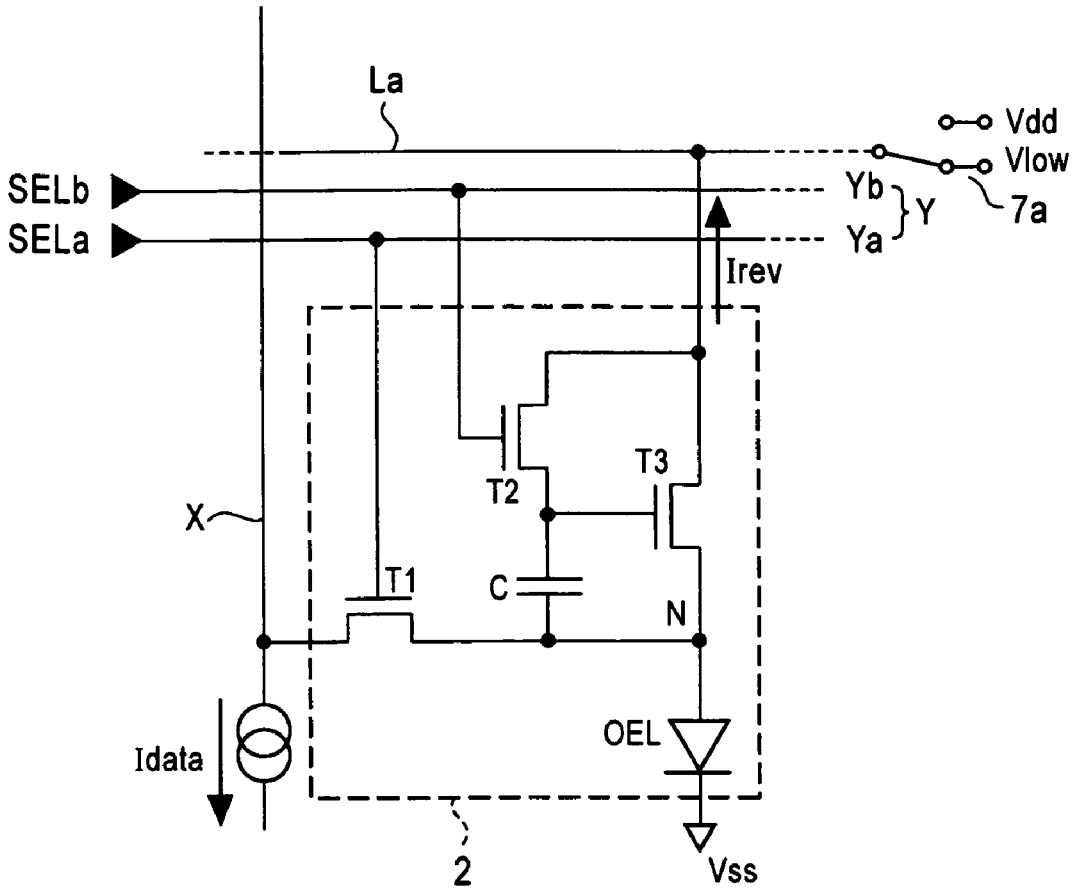
FIG. 6 is a current path in the annealing period.

Then, in the driving period t1 to t2, the driving current IOEL flows through the organic EL element OEL, causing the organic EL element OEL to emit light. After the writing period t0 to t1, the scanning signals SELa and SELb are changed to the L level, and the switching transistors T1 and T2 are turned OFF. This electrically separates the data line X and the source of the driving transistor T3. The gate of the driving transistor T3 is electrically separated from the drain of the driving transistor T3, and also, the diode connection of the driving transistor T3 is canceled. As a result, a driving current path is formed, as shown in FIG. 5, from the power supply voltage Vdd to the reference voltage Vss via the driving transistor T3 and the organic EL element OEL. The driving current IOEL flowing through the organic EL element OEL corresponds to the channel current of the driving transistor T3 disposed between the voltage supply line La and the organic EL element OEL, and the current level is set by the voltage difference Vgs between the gate voltage and the source voltage stored in the capacitor C. The voltage of node N between the driving transistor T3 and the organic EL element OEL in the driving period t1 to t2 sometimes changes according to the level of the driving current. Since the circuit shown in FIG. 5 is a so-called voltage-follower-type circuit in which the capacitor C is disposed between the node N and the driving transistor T3, the gate voltage of the driving transistor T3 is changed according to the voltage of the node N. Accordingly, a change in the voltage of the node N can be compensated for to a certain degree.

In the subsequent annealing period t2 to t3, deterioration or variations in the characteristics (in particular, the threshold voltage) of the driving transistor T3 due to the driving current passing through the driving transistor T3 during the driving period t1 to t2 are compensated for or recovered.

During the annealing period, the scanning signal SELa remains at the L level from the driving period t1 to t2, while the scanning signal SELb is changed to the H level so as to turn ON the second switching transistor T2. In response to this, Vlow is selected from a plurality of potentials by the switch circuit 7, and the potential of the voltage supply line La is set to be Vlow. Then, Vlow is applied to the gate of the driving transistor T3 via the second switching transistor T2. Vlow is also applied to the terminal, which serves as the drain during the driving period t1 to t2.

When Vlow is set close to or lower than the reference voltage Vss, a non-forward bias is applied to the driving transistor T3. If the potential of Vlow is sufficiently low, the reverse bias current Irev flows in the driving transistor T3.

If the voltage having a sign (for example, a negative voltage) different from the sign of the voltage applied to the gate of the driving transistor T3 during the driving period t1 to t2 and the predetermined reference voltage is used as Vlow, a negative voltage is applied to the gate of the driving transistor T3, and the driving transistor T3 is further recovered.

As described above, in this embodiment, the number of transistors included in a pixel circuit of the voltage-follower-type current program system is only three. By reducing the number of transistors forming a pixel circuit as described above, the manufacturing yield or the aperture ratio of the display portion 1 can be improved, and the area occupied by the pixel circuit can be decreased.

The switches 7*a* forming the switch circuit 7 may be operational amplifiers. With this configuration, the potential of the voltage supply line La can be quickly set.

Since the annealing period t2 to t3 is a period in which the organic EL device OEL does not emit light, moving picture characteristics can be improved.

(Second Exemplified Embodiment)

Figure 7:
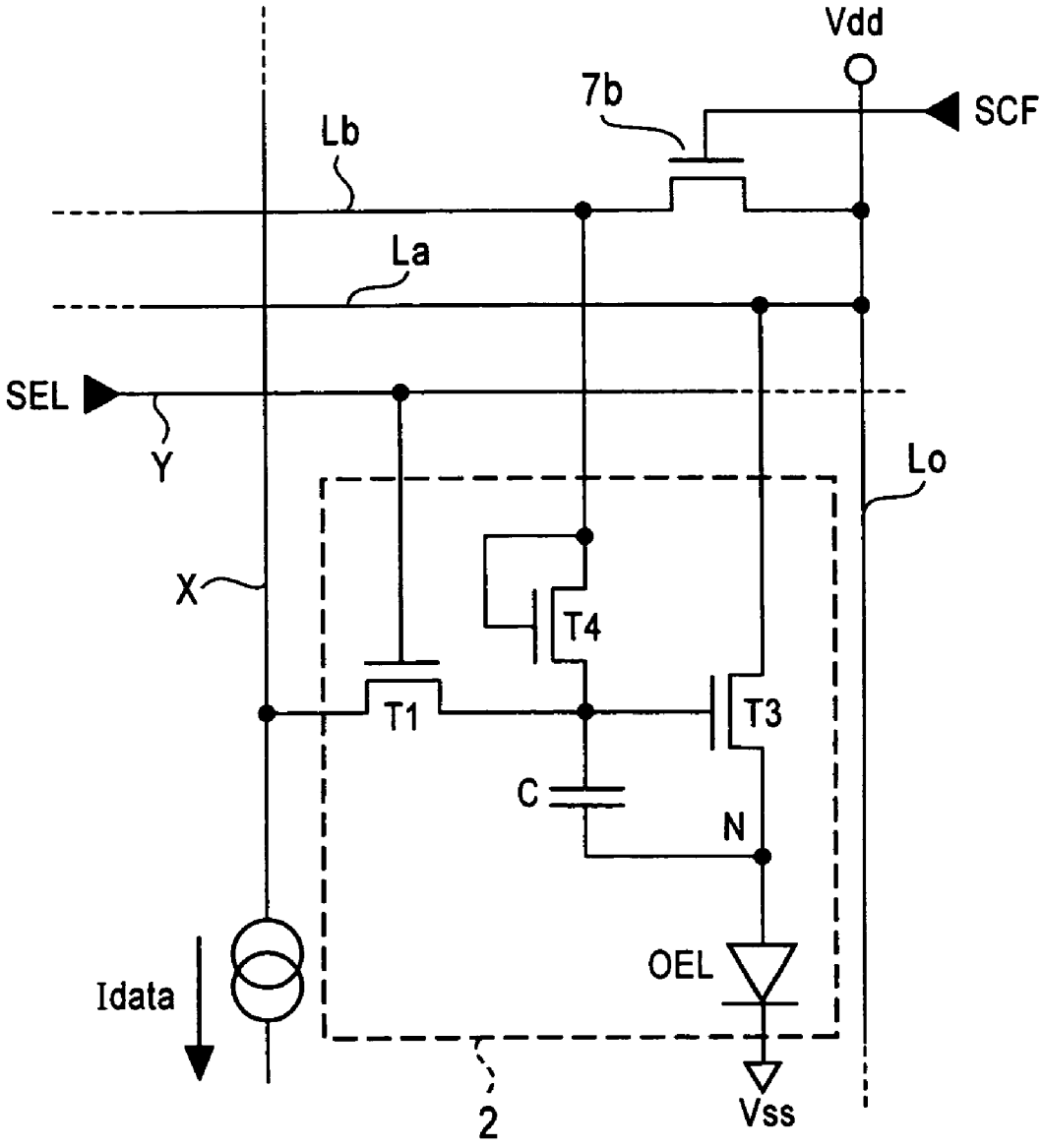
FIG. 7 is a pixel circuit diagram according to a second embodiment.

FIG. 7 is a pixel circuit diagram of a voltage-follower-type current program system according to a second embodiment. In this embodiment, two types of voltage supply lines La and Lb are coupled with a pixel circuit. The second voltage supply line Lb is coupled with a power line Lo via a transistor 7*b* whose conduction state is controlled by the control signal SCF, and the first voltage supply line La is directly connected to the power line Lo.

One pixel circuit is formed of an organic EL element OEL, three n-channel transistors T1, T3, and T4, and a capacitor C for retaining data therein. One of the drain and the source of the switching transistor T1 is coupled with the data line X, and the drain or the source which is not coupled with the data line X is coupled with the gate of the driving transistor T3. The gate of the switching transistor T1 is coupled with the scanning line Y, and the conduction state of the switching transistor T1 is controlled by the scanning signal SEL supplied via the scanning line Y. One of the source and the drain of the compensating transistor T4 is coupled with the gate of the compensating transistor T4, and the source or the drain which is not coupled with the gate of the compensating transistor T4 is coupled with the gate of the transistor T3. The gate of the compensating transistor T4 is coupled with the second voltage supply line Lb.

One of the drain and the source of the driving transistor T3 is coupled with the first voltage supply line La, and the drain or the source which is not coupled with the first voltage supply line La is coupled with the organic EL element OEL. The voltage Vss lower than the power supply voltage Vdd is applied to the cathode (negative electrode) of the organic EL element OEL. One electrode of the capacitor C is coupled with the gate of the driving transistor T3, and the other electrode thereof is coupled with node N for coupling the driving transistor T3 and the organic EL element OEL.

The operation of the above-configured pixel circuit is as follows. The operation process of this pixel circuit is largely divided into a data writing process in the writing period from t0 to t1 and a driving process in the driving period t1 to t2.

Figure 8:
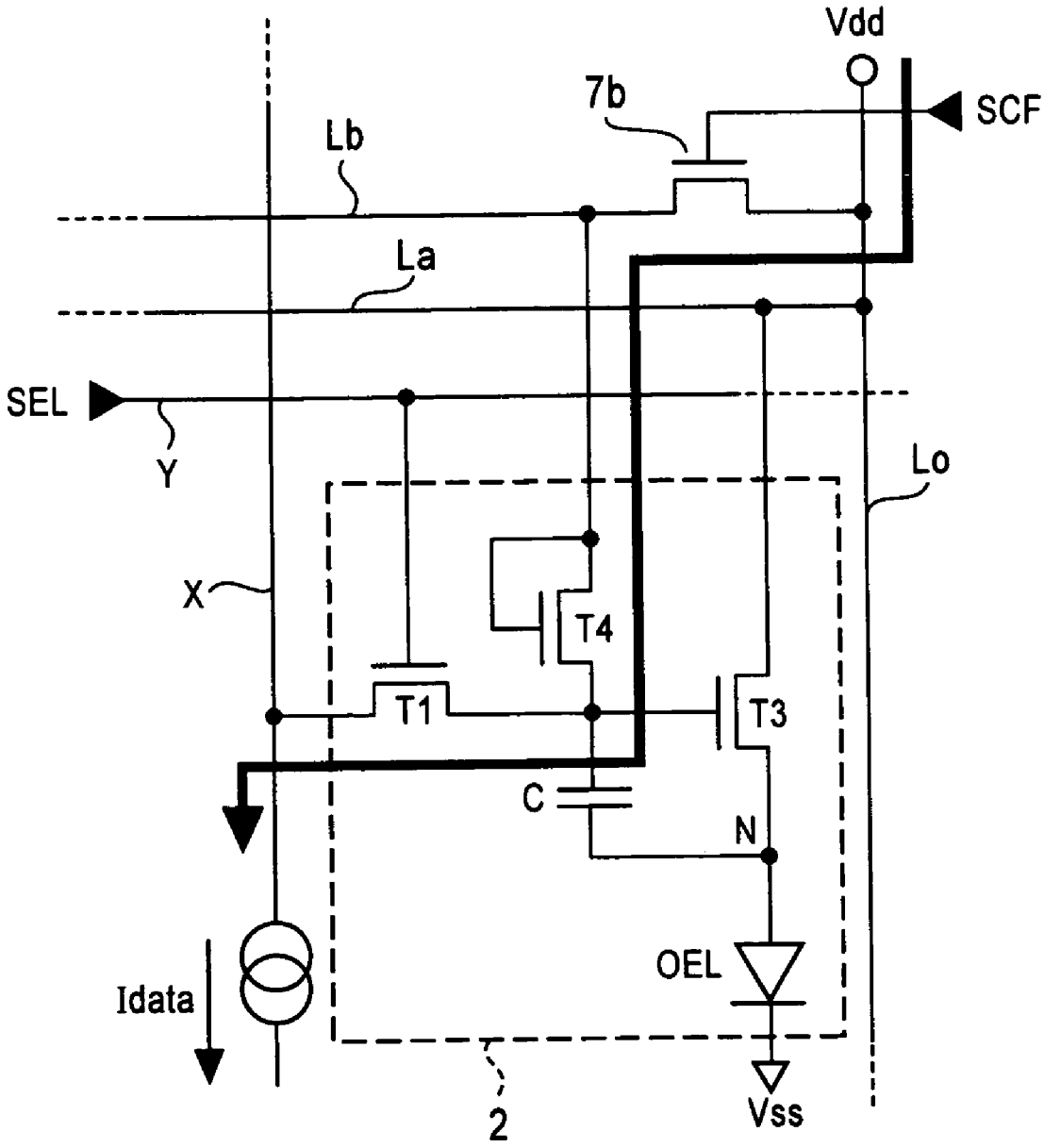
FIG. 8 illustrates a data current path in the writing period.

In the writing period t0 to t1, the scanning signal SEL is changed to the H level so as to turn ON the switching transistor T1. In response to the H level of the scanning signal SEL, the control signal SCF is also changed to the H level so as to turn ON the transistor 7*b*. Accordingly, a path for the data current Idata is formed, as shown in FIG. 8, from the second voltage supply line Lb set at the power supply voltage Vdd to the data line X via the compensating transistor T4 and the switching transistor T1. The data current Idata flows in the channel of the compensating transistor T4, and electric charge based on the generated data current Idata is stored in the capacitor C, and the gate voltage based on the gate current Idata is set.

Figure 9:
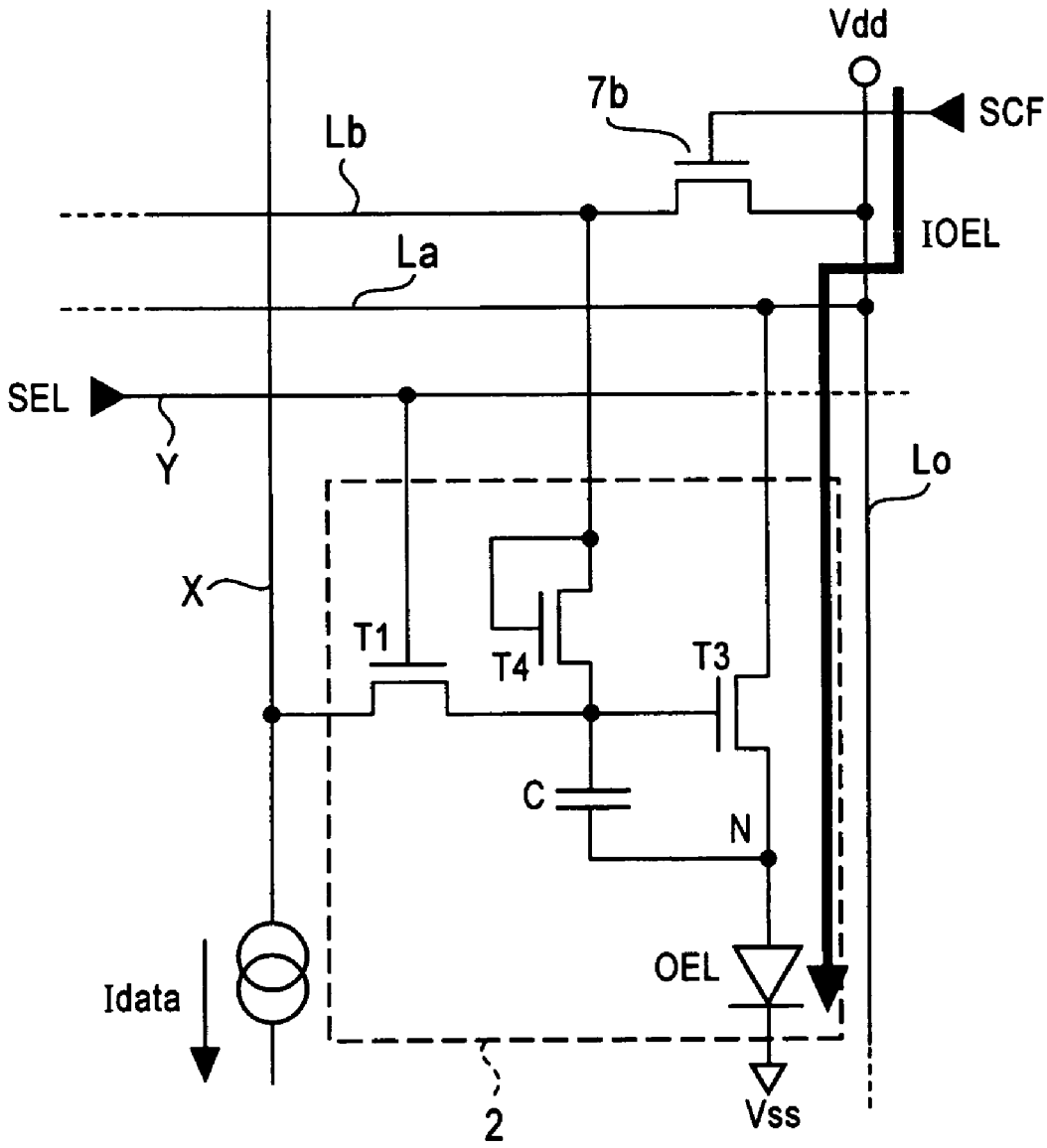
FIG. 9 illustrates a driving current path in the driving period.
Figure 10:
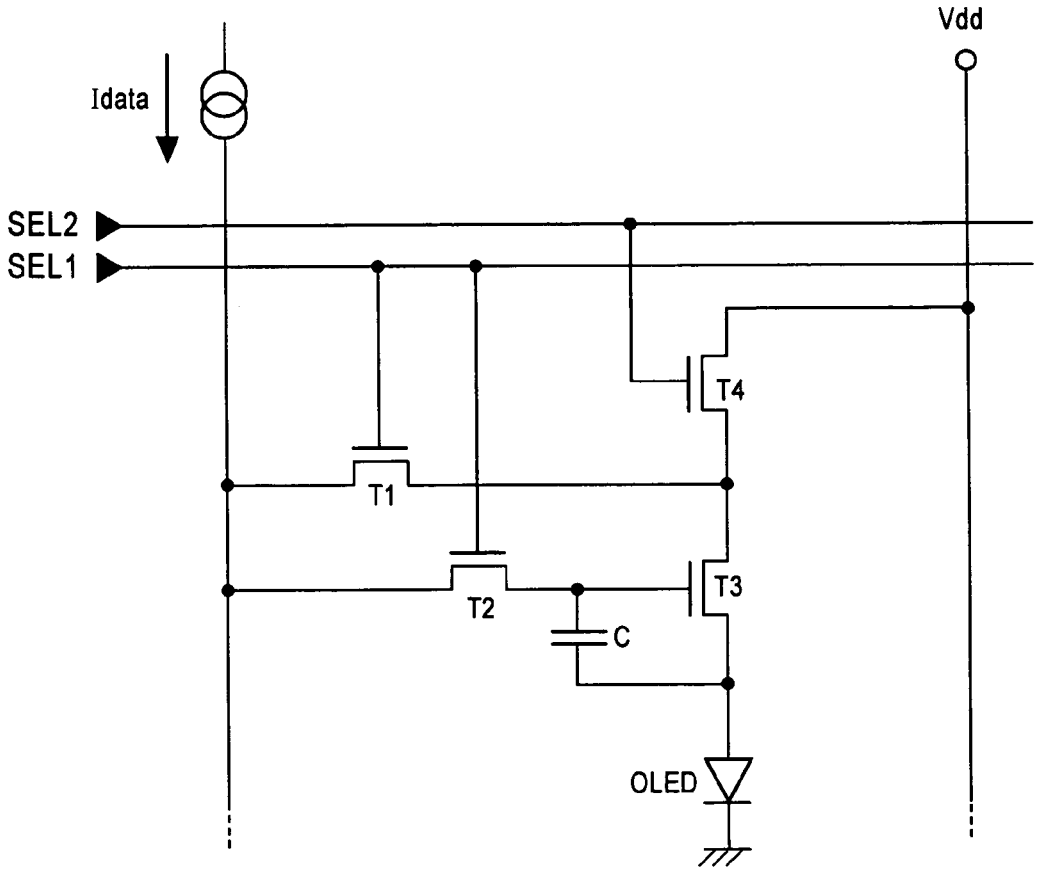
FIG. 10 is a known pixel circuit diagram.

Then, in the driving period t1 to t2, the driving current IOEL based on the gate voltage of the driving transistor T3, which is set by the data current Idata, flows through the organic EL element OEL, causing the organic EL element OEL to emit light. After the above-described writing period t0 to t1, the scanning signal SEL and the control signal SCF are changed to the L level so as to turn OFF the switching transistor T1 and the transistor 7*b*. Accordingly, the gate of the driving transistor T3 is electrically separated from the data line X, and the compensating transistor T4 is electrically separated from the power supply potential Vdd, thereby interrupting the supply of the current to the gate of the driving transistor T3. During the driving period t1 to t2, a path for the driving current IOEL is formed, as shown in FIG. 9, from the power supply voltage Vdd to the reference voltage Vss via the driving transistor T3 and the organic EL element OEL. The driving current IOEL flowing through the organic EL element OEL corresponds to the channel current of the driving transistor T3 disposed between the first voltage supply line La and the organic EL element OEL, and the current level is controlled by the gate voltage Vg determined by the electric charge stored in the capacitor C. The organic EL element OEL emits light with a luminance level based on the driving current IOEL generated by the driving transistor T3, thereby setting the grayscale of the pixel 2.

According to this embodiment, as in the previous embodiment, the number of transistors included in the voltage-follower-type current program system can be reduced. As a result, the manufacturing yield and the aperture ratio of the display portion 1 can be improved, and the area occupied by the pixel circuit can be decreased.

By using the switch 7*a* discussed in the first embodiment instead of the transistor 7*b*, the voltage may be set such that the compensation transistor T4 becomes OFF at least in part of the driving period t1 to t2. Accordingly, the conduction state of compensation transistor T4 can be controlled even by changing the potential of the second voltage supply lines Lb itself instead of the transistor 7*b*, which controls electrical coupling between the second voltage supply line Lb and compensating transistor T4.

In the foregoing embodiments, the organic EL element OEL is used as the electro-optical element. However, the present invention is not restricted to this type of element, and the present invention can find wide applications, such as electro-optical elements (for example, inorganic LED display devices and field emission display devices) and electro-optical devices having the transmittance or reflectance (for example, electrochromic display devices and electrophoretic devices).

The electro-optical devices used in the foregoing embodiments can be installed in various electronic apparatuses, for example, televisions, projectors, cellular telephones, portable terminals, mobile computers, and personal computers. If the above-described electro-optical devices are installed in such electronic apparatuses, the commercial value of the electronic apparatuses can be further improved, and the product appeal in the market can also be enhanced.

The concept of the pixel circuit of the present invention can be applied to various kinds of driven elements as well as electro-optical elements. One of examples to which the concept of the present invention is applied is sensing device such as biochip.

What is claimed is:

1. An electro-optical device comprising:

a plurality of scanning lines;

a plurality of data lines;

a plurality of voltage supply lines;

a switch circuit that controls the supply of a voltage to each of the plurality of voltage supply lines; and a plurality of pixel circuits which are disposed at intersections of the plurality of scanning lines and the plurality of data lines, the plurality of pixels circuits being coupled one of the plurality of voltage supply lines, each of the plurality of pixel circuits including an electro-optical element whose luminance corresponding to a driving current that flows through the electro-optical element, an n-channel driving transistor that is disposed between one of the plurality of voltage supply lines and the electro-optical element and whose a conduction state of the n-channel driving transistor being set according to data, and a capacitor having one electrode coupled with a gate of the n-channel driving transistor and the other electrode coupled with a node that couples the driving transistor and the electro-optical element, the capacitor retaining electric charge based on a data current supplied in a writing period before the driving period via one of the plurality of data lines.

2. The electro-optical device according to claim 1, each of the plurality of pixel circuits further comprising:

a first switching transistor having one terminal coupled with one of the plurality of data lines, the conduction state of the first switching transistor being controlled by a scanning signal supplied via one of the plurality of scanning lines; and a second switching transistor having one terminal coupled with one of the plurality of voltage supply lines and the other terminal coupled with the gate of the driving transistor.

3. The electro-optical device according to claim 1, the plurality of scanning lines including a plurality of first sub-scanning lines and a plurality of second sub-scanning lines, each of the plurality of pixel circuits including a first switching transistor that has one terminal coupled with one of the plurality of data lines and whose conduction state is controlled by a first scanning signal supplied via one of the plurality of first sub-scanning lines, and a second switching transistor that has one terminal coupled with one of the plurality of voltage supply lines and the other terminal coupled with the gate of the n-channel driving transistor and whose the conduction state is controlled by a second scanning signal supplied via one of the plurality of second sub-scanning lines.

4. The electro-optical device according to claim 1, each of the plurality of voltage supply lines being settable to a plurality of voltages.

5. The electro-optical device according to claim 1, a current flowing through the driving transistor in an annealing period in a direction that is opposite to the direction in which the driving current flows.

6. The electro-optical device according to claim 1, the driving transistor in an annealing period being set to a conduction state equivalent to or lower than the lowest conduction state of the conduction states of the driving transistor set by the data current in the writing period.

7. The electro-optical device according to claim 1, the plurality of voltage supply lines being extended in the direction intersecting with the plurality of data lines.

8. An electro-optical device comprising:

a plurality of scanning lines;

a plurality of data lines;

a plurality of voltage supply lines extending in the direction intersecting with the plurality of data lines; and a plurality of pixel circuits which are disposed at intersections of the plurality of scanning lines and the plurality of data lines and which are coupled in common to one of the voltage supply lines, each of the plurality of pixel circuits including a driving transistor, an electro-optical element whose luminance is set in accordance with the conduction state of the driving transistor, and a capacitor having one electrode coupled with the gate of the driving transistor and the other electrode coupled with a node that couples the driving transistor and the electro-optical element, and the capacitor retaining electric charge based on a data current supplied in a writing period before the driving period via one of the plurality of data lines.

9. The electro-optical device according to claim 8, among the plurality of pixel circuits, a group of the plurality of pixel circuits being arranged in a direction in which one of the plurality of scanning lines is extended, and the group being coupled with one of the plurality of voltage supply lines.

10. The electro-optical device according to claim 8, each of the plurality of pixel circuits including the driving transistor, a first switching transistor being controlled by a scanning signal supplied via one of the plurality of scanning lines, and a second switching transistor that controls electrical coupling between the gate and the drain of the driving transistor, all transistors included in each of the plurality of pixel circuits being only the driving transistor, the first switching transistor, and the second switching transistor.

11. An electro-optical device comprising:

a plurality of scanning lines;

a plurality of data lines; and a plurality of pixel circuits disposed at intersections of the plurality of scanning lines and the plurality of data lines, each of the plurality of pixel circuits including an electro-optical element, a driving transistor having a first terminal and a second terminal between which channel region is provided, a capacitor that has a first electrode coupled with a first gate of the driving transistor and a second electrode coupled with the first terminal, a first transistor that has a second gate coupled with one of the plurality of scanning lines and that has a third terminal and a fourth terminal between which a channel region is provided, and a second transistor that has a third gate and that has a fifth terminal and a sixth terminal between which a channel region is provided, the fourth terminal being coupled with one of the plurality of data lines, the electro-optical element being coupled with the first terminal, and all transistors included in each of the plurality of pixel circuits being the driving transistor, the first transistor, and the second transistor.

12. The electro-optical device according to claim 11, the fifth terminal being coupled with the first gate, and the sixth terminal being coupled with the second terminal.

13. The electro-optical device according to claim 11, the third terminal being coupled with the second electrode of the capacitor and with the first terminal.

14. The electro-optical device according to claim 11, the fifth terminal being coupled with the first gate, and the sixth terminal being directly connected to the third gate.

15. The electro-optical device according to claim 14, further comprising:

a plurality of first voltage supply lines; and a plurality of second voltage supply lines, the second terminal being coupled with one of the plurality of first voltage supply lines, the sixth terminal being coupled with one of the plurality of second voltage supply lines, and each of the plurality of second voltage supply lines being settable to a plurality of potentials.

16. The electro-optical device according to claim 14, further comprising:

a plurality of first voltage supply lines; and a plurality of second voltage supply lines, the second terminal being coupled with one of the plurality of first voltage supply lines, the sixth terminal being coupled with one of the plurality of second voltage supply lines, and each of the plurality of second voltage supply lines being settable to either one of a predetermined voltage and a floating state.

17. The electro-optical device according to claim 15, the plurality of voltage supply lines being extended in the direction intersecting with the plurality of data lines.

18. The electro-optical device according to claim 14, further comprising:

a plurality of first voltage supply lines; and a plurality of second voltage supply lines, the second terminal being coupled with one of the plurality of first voltage supply lines, the sixth terminal being coupled with one of the plurality of second voltage supply lines, and one of the second voltage supply lines being set to a predetermined potential at least in part of a writing period in which the conduction state of the driving transistor is set according to a data current to pass through the second transistor.

19. The electro-optical device according to claim 11, the driving transistor, the first transistor, and the second transistor being formed of amorphous silicon.

20. An electronic apparatus comprising the electro-optical device set forth in claim 11.

* * * * *